US005485662A

United States Patent [19]

Hodges, Jr. et al.

[11] Patent Number: 5,485,662

[45] Date of Patent: Jan. 23, 1996

[54] APPARATUS AND METHOD FOR CRIMPING FIBER FOR NONWOVEN APPLICATIONS

[75] Inventors: Ray W. Hodges, Jr.; Shiv Sibal, both of Conyers, Ga.

[73] Assignee: Hercules Incorporated, Wilmington, Del.

[21] Appl. No.: 235,306

[22] Filed: Apr. 29, 1994

[51] Int. Cl.[6] ..... D02G 1/12

[52] U.S. Cl. ..... 28/263; 28/267

[58] Field of Search ..... 28/263, 265, 266, 28/267

[56] References Cited

U.S. PATENT DOCUMENTS

| | | | |
|---|---|---|---|
| 3,340,585 | 9/1967 | Buckley et al. | 28/267 X |
| 3,751,778 | 8/1973 | Grosjean et al. | 28/267 X |
| 3,810,285 | 5/1974 | Ferrier et al. | 28/267 X |
| 4,115,907 | 9/1978 | Lawson et al. | 28/267 X |
| 4,258,457 | 3/1981 | Hughes et al. | 28/267 X |
| 4,620,345 | 11/1986 | Fleissner | 28/266 |
| 4,956,901 | 9/1990 | Koskol et al. | 28/267 X |

OTHER PUBLICATIONS

Derwent Abstract No. 73-12433U.

M. Horio, "The Theory of Crimp of Textile Fibers", pp. 222-273, Apr. 18, 1964.

C. H. McGill, "Modern Crimping Techniques", Fiber World, pp. 51-56, Jun. 1984.

B. Xu et al., "Characterizing Fiber Crimp by Image Analysis: Definitions, Algorithms, and Techniques", Textile Res. J. 62(2), 73-80 (1992).

*Primary Examiner*—John J. Calvert

*Attorney, Agent, or Firm*—Mark D. Kuller

[57] ABSTRACT

Apparatus and method for crimping fiber, especially polypropylene fiber, includes feeding a tow through driven rolls into a stuffer box. Heat, in the form of steam, is applied to the tow prior to the rolls. The stuffer box includes doctor blades for cooling the tow. The doctor blades include a leading tip portion, through which compressed air is fed over the tow, and a trailing section including at least one internal compartment for a cooling fluid.

62 Claims, 4 Drawing Sheets

APPARATUS AND METHOD FOR CRIMPING FIBER FOR NONWOVEN APPLICATIONS

BACKGROUND OF THE INVENTION

1. Field of the Invention

The present invention relates to crimping equipment used in the manufacturing of fibers, especially polyolefin fibers, and a process for crimping fibers. Further, this invention relates to fibers for nonwoven applications, especially polyolefin fibers such as polypropylene fibers.

2. Discussion of the Background Information

Crimpers are used in processing fibers to add bulkiness, cohesiveness, and cardability. A crimper works by having two driven rolls pinch the tow and force it into a confined space, known as a stuffer box. The stuffer box includes two doctor blades positioned close to the driven rollers, and side plates. Crimping occurs because the filaments are forced against a cake of more slowly moving filaments. Traditionally heat, in the form of steam, has been used ahead of the crimper to soften the filaments prior to crimping. Additionally, heat, also in the form of steam, is fed through holes in the doctor blades into the stuffer box to lubricate the tow. As disclosed by McGill, *Modern Crimping Techniques*, Fiber World, pp. 51–55, the entire disclosure of which is hereby incorporated by reference, the doctor blades can be positioned at a variety of angles in relationship to the driven rolls. Further, McGill discloses that the top doctor blade may be hinged, and that the driven rolls may be hollow in order to circulate temperature-control fluids.

U.S. Pat. No. 4,620,345, to Fleissner, the entire disclosure of which is hereby incorporated by reference, discloses an apparatus for crimping including a pair of delivery rolls, a stuffer box, a chute following an outlet of the stuffer box for supplying the crimped fiber to a sieve drum for setting the crimp, with the sieve drum being traversed by cooling air.

Technological changes in fibers, involving lower denier per filament, lower draw ratios, and skin/core structure have made crimping more difficult and has lowered usable temperature levels in the crimper. Specifically, the application of too much heat to the fibers causes them to fuse. By lowering the temperature, the undesirable sticking together of filaments can be avoided; however, the use of lower temperatures makes it difficult to reach desired crimp levels.

SUMMARY OF THE INVENTION

This invention relates to an apparatus for crimping fiber without fusing the filaments. Specifically, the invention relates to the stuffer box of a crimper. Stuffer boxes are preferably composed of doctor blades and side plates. More specifically, the present invention preferably provides cooling in both the wear tip and trailing portions of the stuffer box enabling cooling throughout the stuffer box, while preventing the filaments from sticking together and reducing burnishing damage to the filaments and the filament crimp.

It is an object of the present invention to provide a crimper for crimping fiber, comprising a stuffer box comprising a first doctor blade; a second doctor blade opposing said first doctor blade; and means for feeding fiber into the stuffer box. Further, there are provided means for cooling the stuffer box. These means can include means for directly cooling the stuffer box so as to indirectly cool fiber passing through said stuffer box. Preferably, these means can include means for directly cooling the stuffer box with a chilled cooling medium so as to indirectly cool fiber passing through the stuffer box, or means for directly cooling the stuffer box with a liquid cooling medium so as to indirectly cool fiber passing through the stuffer box. Further, the means for cooling can comprise means for cooling the stuffer box with a cooling medium, such as a liquid cooling medium, either in direct or indirect contact with either or both blades.

Each of the first doctor blade and the second doctor blade can comprise a wear tip portion and a trailing portion, and the means for directly cooling the stuffer box so as to indirectly cool fiber can be positioned at the trailing portion of one or both of the doctor blades.

The means for directly cooling the stuffer box so as to indirectly cool fiber can comprise at least one internal compartment for flow of cooling fluid in at least one of, or in both of, the first doctor blade and the second doctor blade. The internal compartment can comprise a plurality of compartments, either separate or connected by passages.

At least one of the wear tip portions, or both of the wear tip portions, of the first doctor blade and the second doctor blade can comprise means for cooling, such as at least one internal passage including a plurality of exit apertures to inject a fluid into the stuffer box.

The wear tip portion and the trailing portion of each of the first doctor blade and the second doctor blade can comprise separate portions or can be of one-piece construction. Further, the first doctor blade and the second doctor blade can further comprise a main body including at least one internal passage connected with the at least one internal passage in the at least one wear tip portion; at least one internal passage for supplying cooling fluid to the at least one internal compartment; and at least one internal passage for removing cooling fluid from the at least one internal compartment.

The trailing portion of at least one of the first doctor blade and the second doctor blade can further comprise at least one internal passage including a plurality of exit apertures to direct a fluid into the stuffer box.

Moreover, the crimper can comprise opposing side plates, as well as means for connecting the doctor blade to the two opposing side plates. The means for connecting can comprise adjustable connecting means for adjusting the doctor blade to the opposing side plates. The first doctor blade and the second doctor blade can be adjustably positioned opposing each other at a distance between about 15 mm and 60 mm. Moreover, one of the doctor blades is adjustable by the dimensioning and construction thereof. In this regard, either of the two doctors blades can be the doctor blade that is connected to the adjustable connecting means so as to be adjustably positioned, or the doctor blade that is adjustable by dimensioning and construction thereof.

The crimper can comprise means for applying pressure within the stuffer box; the two opposing side plates can further comprise inserts positioned opposing the driven rolls and the means for feeding fiber can comprise driven rolls. The first doctor blade and the second doctor blade can be positioned from the driven rolls at a distance between about 0.001 inch and 0.020 inch, and the driven rolls can be spaced apart a distance of about 0.004 inch to 0.006 inch.

In another aspect, the present invention is directed to a crimper for crimping fiber, comprising a stuffer box comprising a first doctor blade comprising a wear tip portion and a trailing portion; a second doctor blade opposing the first doctor blade comprising a wear tip portion and a trailing portion; two opposing side plates; means for feeding fiber into said stuffer box; each said trailing portion of the first doctor blade and the second doctor blade comprising at least one internal compartment for flow of cooling liquid within each respective trailing portion; and each said wear tip portion of the first doctor blade and the second doctor blade comprising at least one internal passage including a plurality of exit apertures to inject a fluid into the stuffer box.

The present invention is also directed to process for crimping fiber comprising heating the fiber; feeding the heated fiber, at a rate capable of crimping the fiber, into a stuffer box having a first doctor blade, a second doctor blade opposing said first doctor blade, and two opposing side plates; and cooling the fiber as the fiber passes through the stuffer box with a cooling fluid which directly cools the stuffer box and indirectly cools the fiber, or with a cooling fluid, such as a liquid, which indirectly contacts the stuffer box and the fibers.

The processes according to the present invention can utilize the various apparatus as described above, which for the sake of brevity will not be repeated. However, it is noted that the means for cooling of the trailing portion of the first and second doctor blades can comprise at least one internal compartment, and the cooling can comprise circulating cooling fluid, such as a liquid or a chilled cooling medium, including a chilled liquid, within the at least one internal compartment of the first and second doctor blades. The heating step of the process can further comprise applying steam, preferably between about 0 and 40 psi.

Further, the process can include providing the wear tip portions of the first and second doctor blades with at least one internal passage including a plurality of exit apertures, and applying air through the plurality of exit apertures. The cooling fluid in the internal compartments can be at a temperature between about 5° C. and 40° C., and the compressed air can have a temperature between about 5° C. and 40° C. The heating step of the process can comprise applying steam, preferably between about 0 and 40 psi.

In a further embodiment of the process according to the present invention, the trailing portions of the first and second doctor blades further comprise at least one internal passage including a plurality of exit apertures, and the process can further comprise applying air through the plurality of exit apertures in the trailing portion, preferably at a pressure between about 0.5 and 15 psi.

The process can further comprise applying pressure within the stuffer box; the temperature of the fiber entering the stuffer box can be between about 120° F. and 200° F.; and the temperature of the fiber leaving the stuffer box can be between about 130 and 180° F.

The process of the present invention enables flexibility by providing control of temperatures inside and outside the stuffer box. For example, a process for crimping fiber which enables control of crimping by adjusting temperature conditions, can comprise heating the fiber; feeding the heated fiber, at a rate capable of crimping the fiber, into a stuffer box comprising a first doctor blade comprising a wear tip portion and a trailing portion; a second doctor blade opposing the first doctor blade comprising a wear tip portion and a trailing portion; two opposing side plates; each said trailing portion of the first doctor blade and the second doctor blade comprising at least one internal compartment for flow of liquid within each respective trailing portion; and each said wear tip portion of the first doctor blade and the second doctor blade comprising at least one internal passage including a plurality of exit apertures to inject a fluid into the stuffer box; controlling at least one of flow rate and temperature of a liquid flowing through the internal compartment in each of the first doctor blade and the second doctor blade; and controlling at least one of flow rate and temperature of the fluid being injected into the stuffer box.

A still further embodiment of the present invention is to provide a fiber made by the process according to the present invention. Preferably, the fiber is a polyolefin. More preferably, the polyolefin is selected from the group consisting of polypropylene, polyethylene, or mixtures thereof. Even more preferably, the polyolefin is polypropylene. The fiber may include about 10–50 crimps per inch.

According to another embodiment, the present invention comprises a doctor blade including a wear tip portion; and a trailing portion including means for internal cooling. The means for cooling comprises at least one internal compartment for flow of cooling fluid, such as a liquid such as water. The wear tip portion of the doctor blade comprises at least one internal passage including a plurality of exit apertures.

The at least one internal compartment for flow of cooling fluid comprises a plurality of internal compartments, preferably connected through at least one flow passage, and the trailing portion further comprises at least one internal passage including a plurality of exit apertures.

The cooling effects of the present invention allow use of more heat before the crimper for better crimp formation. The cooling fluid, such as air, at the wear tip portion tends to keep the filaments from sticking together and provides lubrication. The cooling compartment in the trailing portion, such as a water-cooled compartment, reduces burnishing damage to the filaments and to the filament crimp, and tends to set the crimp against pull-out. Adjustment of the cooling fluid at the wear tip portion and cooling provided by the cooling compartment in the trailing portion yields improved flexibility and control of product properties, including crimp and average cohesion, and enables the obtaining of a fiber that can be thermal bonded into a non-woven fabric possessing high uniformity.

More specifically, in a preferred embodiment of the invention, the wear tip is a separate part of the doctor blade with internal ducts for compressed air to be piped through for injection under and above the tow cake, as it slides through the stuffer box. The air cools, softens, and helps the crimped tow cake slide through the trailing section of the stuffer box. The trailing section of the doctor blades have smooth surfaces, preferably without openings, and internal compartments for water cooling to lower overall temperatures to reduce burnishing/fusion and to set the crimp before tension is applied to carry the tow to the next process step.

Still further, the invention provides significant improvement in crimpability. The crimpability improvement relates directly to fibers with improved cohesion.

BRIEF DESCRIPTION OF THE DRAWINGS

Embodiments of the present invention are shown in the accompanying drawings, in which like reference numerals represent similar parts throughout the several views of the drawings, wherein.

DETAILED DESCRIPTION OF THE PREFERRED EMBODIMENTS

The term "doctor blade" as used herein, refers to elements associated with the stuffer box through which the filaments to be crimped are driven, such as an upper plate and a lower plate, or left and right plates, associated with the stuffer box. The doctor blade can include, as part of the plate, a portion that ensures the directing of the filaments from the driven rolls into the stuffer box. Alternatively, the portion that ensures the directing of the filaments into the stuffer box can be a portion separate from the plates. For the sake of convenience, in this application, the term "doctor blade" will collectively refer to the plate separate from the portion that directs the filaments into the stuffer box and to the plate including the portion that directs the filaments into the stuffer box.

The term "direct cooling", as used herein, refers to direct contact between the cooling fluid or liquid and the material being cooled, whereas the term "indirect cooling", as used herein, refers to the cooling fluid or liquid not being in direct contact with the material being cooled. For example, direct cooling of fibers includes contact of the cooling fluid with the fibers, and indirect cooling of fibers includes cooling without any contact of the cooling fluid or liquid with the fibers.

Figure 1:
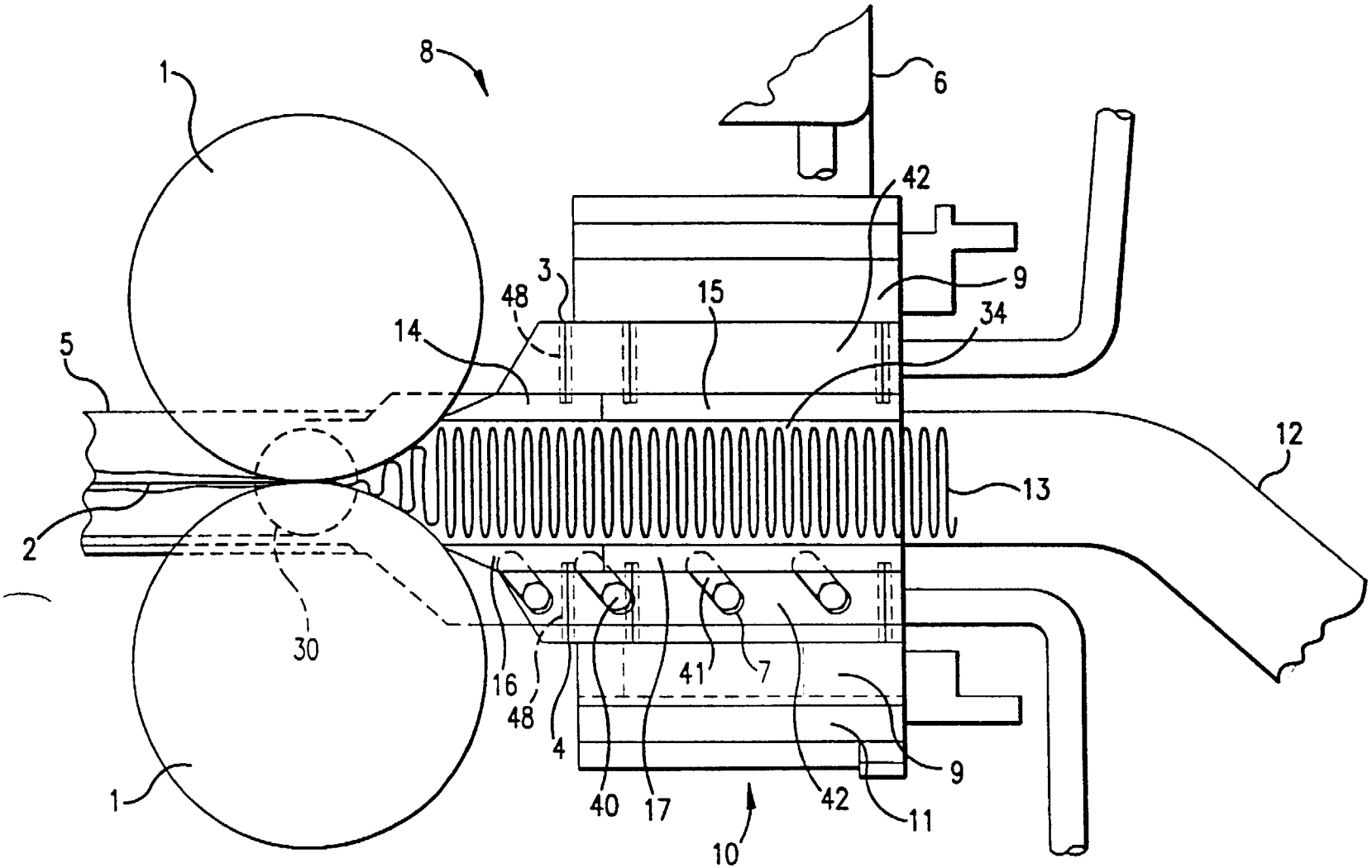
FIG. 1 is a cross-sectional, schematic view of the crimper assembly according to the present invention.

As shown in FIG. 1, the crimper 8 includes driven crimper rolls 1 that pinch the tow 2 to pull it toward the stuffer box 10 and to push the tow into the stuffer box 10. The clearance between the driven rolls can be between about 0.001 inch and 0.006 inch, preferably between about 0.004 inch and 0.006 inch.

The stuffer box 10 includes a top doctor blade 3, a bottom doctor blade 4 and side plates 5, which define a space 34 in which the fiber is crimped. Pressure, known as flapper pressure, is applied within the stuffer box 10 by pressurizing the top doctor blade 3 with a mechanism for applying pressure 6. Such mechanism for applying pressure to the top doctor blade 3 may be any pressure means known in the art, and can, for example, include an air cylinder to provide pressure.

Both doctor blades 3 and 4 fit closely to the driven crimper rolls 1 to guide the tow 2 into the stuffer box 10 and prevent the tow 2 from wrapping around the rolls 1. The clearance between the doctor blades 3 and 4 and the driven rolls 1 is between about 0.001 and 0.020 inch, preferably between about 0.014 inch and 0.016 inch. The distance between the top doctor blade 3 and the bottom doctor blade 4 is between about 15 mm and 60 mm, preferably between about 40 mm and 60 mm.

FIG. 1 illustrates the adjustable attachment means 7 for the bottom doctor blade 4. In this regard, in this embodiment, the bottom doctor blade 4 is attached to the side plates 5 by adjustable attachment elements 7. The top doctor blade 3 adjustable by the dimensioning and construction thereof. The adjustable attachment elements 7, which, for example, include bolts 40 and slots 41 in side plates 5, enables the distance between the top and the bottom doctor blades 3 and 4 to be changed, as well as changing the clearance between the doctor blades and the driven rolls 1, depending upon the type of fiber being crimped and the amount of crimp desired. The slots are angled to accommodate the horizontal movement needed to maintain the distance between the doctor blade and the driven crimper rolls 1 as the vertical distance between the doctor blades is changed.

The crimper also includes intermediate plates 9 positioned next to the top bottom doctor blade 3 and the bottom doctor blade 4. Guide plates 11 are positioned next to the intermediate plates 9. The thickness of the intermediate plate 9 can also be changed to accommodate the adjustment of the distance between the top and bottom doctor blades. The side plates 5 are indented at the point where the driven rolls 1 pinch the tow 2. Rotating circular brass or bronze inserts 30 are positioned in the indentations to prevent the tow 2 from being pushed out the sides of the driven rolls 1.

The difference in the high speed of the driven crimper rolls 1 and the slow take-away of the tow from the back end of the stuffer box 10 causes the tow to cake. The filaments buckle or crimp against the cake inside the stuffer box 10. An exit chute 12 is positioned at the end of the crimper 10 to guide the crimped tow 13 away from the crimper.

As shown in FIG. 1, the top and bottom doctor blades include a main body 42, a wear tip portion 14 and a trailing portion 15. The top doctor blade is shown in detail in FIGS. 2–9. The bottom doctor blade is preferably substantially identical to the top doctor blade, and so as to not be unduly duplicative, the figures of drawings of the bottom doctor blade are not illustrated. However, any discussion and/or illustration of the top doctor blade can also be considered to be a discussion and/or illustration of the bottom doctor blade.

Figure 4:
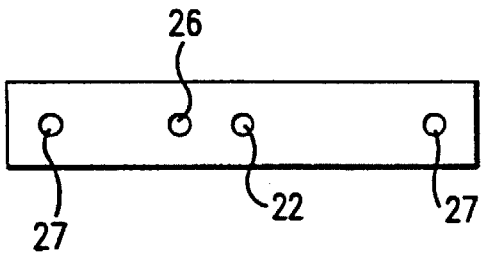
FIG. 4 is a rear view of the main body of the top doctor blade.
Figure 2:
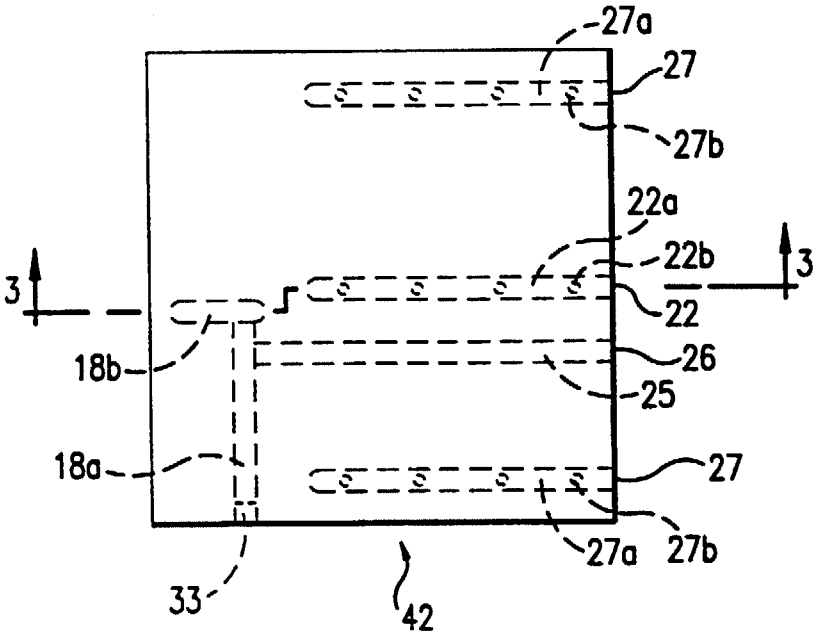
FIG. 2 is a top view of the main body of the top doctor blade according to the present invention.
Figure 3:
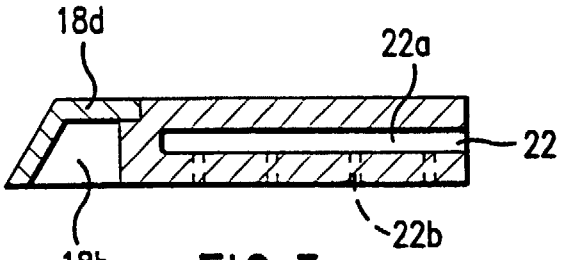
FIG. 3 is a cross-sectional view taken along line 3—3 in FIG. 2.

The main body 42 of the top doctor blade 3 is shown in FIGS. 2–4. The trailing portion 15 is shown in detail in FIGS. 5 and 6. The wear tip section 14 is shown in detail in FIGS. 8 and 9. The wear tip portion 14 and the trailing portion 15 are both connected to the main body by connection means, such as a plurality of bolts 48, shown schematically in FIG. 1.

Figure 9:
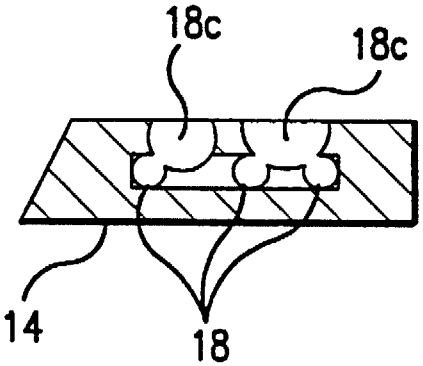
FIG. 9 is cross-sectional view taken along line 9—9 in FIG. 8.

The main body of the top doctor blade, as shown in FIGS. 2 and 3, includes passageways for feeding compressed air to the wear tip section and cooling fluid to and from the trailing portion. Specifically, the compressed air enters the top doctor blade 3 through entrance opening 26 and travels through the main body of the doctor blade 3 by way of internal passage 25, which connects with the at least one internal passage 18*a* which in turn connects with open space 18*b*. As shown in FIG. 3, open space 18*b* extends over substantially the entire height of the main body 42. The open space is made by any method known in the art. In one preferred method the space is drilled through the main body and cap 18*d* is placed over the space. The open space 18*b* connects with at least one internal passage 18 in the wear tip section 14 through at least one lower portion 18*c*, as shown in FIG. 9. The number of internal passages both for supplying the compressed air to the wear tip section and within the wear tip section may be changed depending upon the amount of air desired. Further, the pattern in which the internal passages are connected and the number of exit apertures may also be varied.

Figure 8:
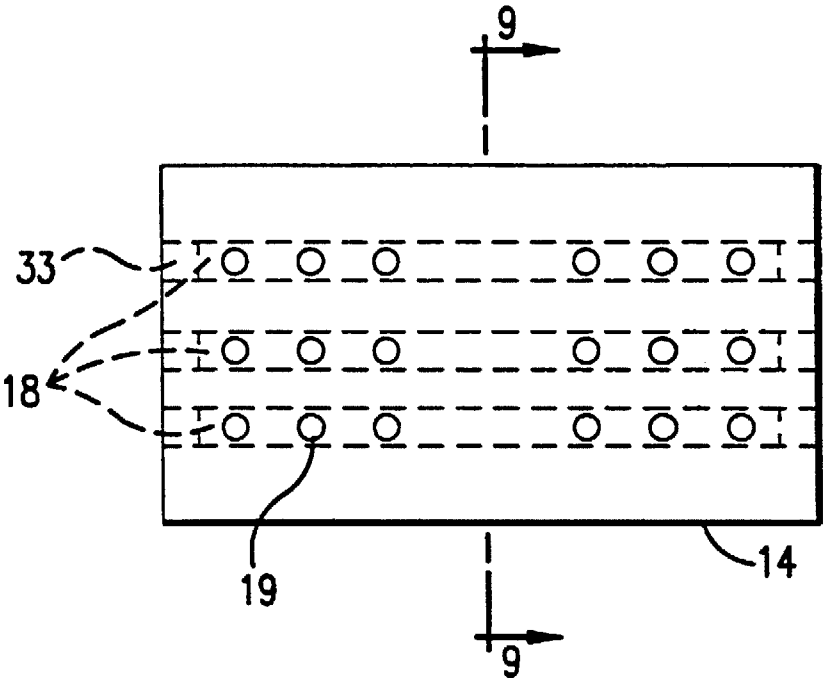
FIG. 8 is a bottom view of the wear tip of the top doctor blade according to the present invention.

As noted above, wear tip section 14 includes at least one internal passage 18 which is used for the application of compressed air into the stuffer box 10 by way of a plurality of exit apertures 19, which are shown in FIG. 8. The at least one internal passage 18 in wear tip section 14 and the at least one internal passage 18*a* in main body 42 are made by any manner known in the art. One preferred way is by drilling internal passages 18 through the width of the wear tip section. As shown in FIGS. 2 and 8, plugs 33 are inserted into the drilled internal passages 18 to prevent the compressed air from leaking out the ends.

The compressed air cools the tow cake from above and below as it slides through the stuffer box 10. The air cools, softens, and helps the crimped tow cake slide through the trailing section of the stuffer box 10.

As shown in FIGS. 2–4, main body 42 includes means for feeding cooling fluid, such as a chilled cooling fluid, a liquid, a chilled liquid, preferably, water or cooled water, into and out of the trailing portion 15 of the top doctor blade. The cooling fluid is fed through the at least one internal compartment 20, to provide further cooling of the tow 2 within the stuffer box 10. Specifically, the cooling fluid enters the main body 42 of the doctor blade through entrance opening 22, flows through at least one entrance flow passage 22*a* and at least one entrance flow tube 22*b* into internal compartment 20 of the trailing portion 15. The cooling fluid is removed from the internal compartment 20 by at least one exit flow tube 27*b*, and at least one exit flow passage 27*a* and out of at least one exit 27.

Figure 7:
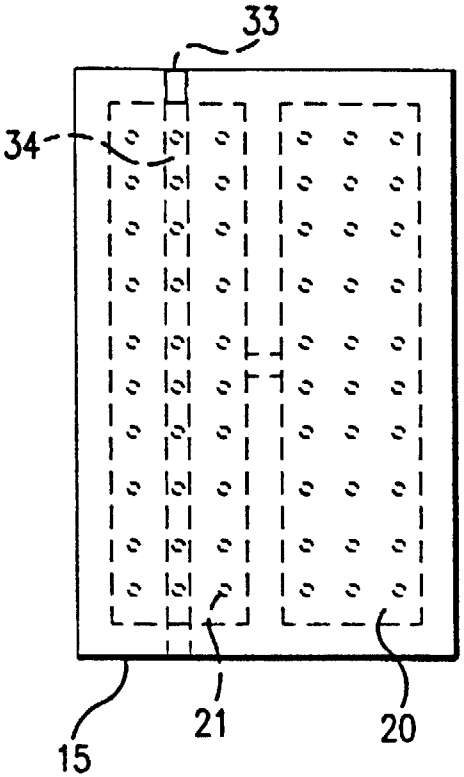
FIG. 7 is a top view of the trailing portion of the top doctor blade according to a further embodiment of the present invention.
Figure 5:
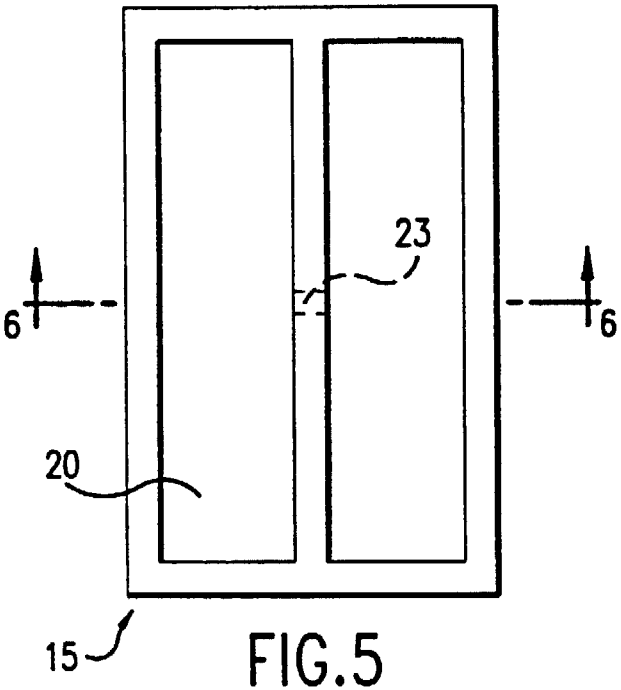
FIG. 5 is a top view of the trailing portion of the top doctor blade according to the present invention.
Figure 6:
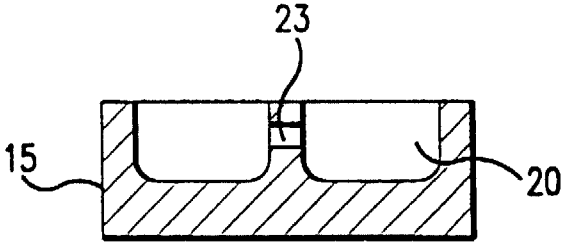
FIG. 6 is a cross-sectional view taken along line 6—6 in FIG. 5.

As shown in FIGS. 5–7, the trailing portion can have a plurality of internal compartments 20 each of which, as shown in FIG. 2, can be connected to the main body by a plurality of entrance tubes 22*b* and a plurality of exit flow tubes 27*b*. Additionally, the internal compartments 20 can be connected by at least one flow passage 23, as shown in FIGS. 5 and 6. The shape, number and connection of the internal compartments, as well as the number of inlets and outlets for the cooling fluid can be varied.

While in the illustrated preferred embodiment, the cooling of the doctor blades, e.g., the trailing portion of the doctor blade, is achieved by directly cooling the doctor blade by circulating liquid, such as water, through an internally located compartment, other means for cooling can be used. In this regard, any means that can indirectly cool the fiber passing through the stuffer box can be used, even if these means indirectly cool the doctor blade. For example, the means for cooling can comprise a compartment or conduit external to the doctor blade with a fluid, such as a gas or liquid, passing therethrough, which indirectly cools the doctor blade and also achieves indirect cooling of the fibers. Also, any means that can lower the temperature of the doctor blade, while indirectly cooling the fibers, would be within the scope of present invention.

FIG. 4 is a rear view of the main body 15 of the top doctor blade 3, which as described above, includes an entrance opening 26 for compressed air, an entrance opening 22 for cooling fluid and at least one exit 27 for removal of cooling fluid.

In another embodiment according to the present invention, as shown in FIG. 7, the trailing portion 15 of the top doctor blade 3 includes at least one internal compartment 20 for the circulation of a cooling fluid, and at least one internal passage 34, including a plurality of exit apertures 21, for flow of compressed air therethrough. The number and pattern of the internal passages for circulation of cooling fluid and compressed air, as well as the number of exit apertures can be varied. This embodiment enables the provision of compressed air at both the wear tip and trailing portions of the doctor blade.

The process of crimping fiber begins by heating the tow prior to the crimper. For example, steam is applied in a steam chest upstream of the crimper at a pressure between about 0 and 40 psi, preferably between about 0 and 10 psi. In a preferred embodiment, the steam chest is hinged and can be operated in an open position which allows for the application of no steam. The steam chest can also be operated in the closed position with or without steam being applied. As the tow enters the crimper its temperature is between about 120° F. and 200° F., preferably between about 150° F. and 200° F. Flapper pressure is applied in the stuffer box at between about 2 and 10 bars, preferably between about 5 and 8 bars. Compressed air is fed to the doctor blades at a gauge pressure between about 0.5 to 15.0 psi, preferably about 3.0 to 5.0 psi.

The compressed air enters the crimper through a plurality of apertures in the wear tips of the doctor blades. A cooling fluid, specifically water, is fed through the internal compartments in the trailing sections of the doctor blades, which, by automatic control of flow and temperature, maintains a fluid temperature between about 5° C. and 40° C., preferably between about 8° C. and 20° C. The temperature of the tow is reduced by as much as 20° F. to 30° F. The temperature of the fiber leaving the stuffer box is between about 90° F. and 180° F.

The specific steam pressure, flapper pressure, air pressure and temperature of the cooling fluid used in the crimping process may vary depending upon the properties desired in the product. For example, applying pre-crimper steam adds heat to allow the fiber to be crimped easier. The application of higher air pressure results in a softer fiber that flows through the apparatus easier. Increased flapper pressure reduces the flow through the apparatus and increases the crimps per inch. Further, increased flapper pressure increases the contact of the tow with the apparatus and thereby improves the cooling to reduce the fusion between the filaments and set the crimp. A set crimp reduces the possibility that the crimp will pull out during further processing.

In another embodiment of the process according to the present invention, compressed air is fed into the stuffer box both through apertures in the wear tip portion of the doctor blade and through apertures in the trailing portion of the doctor blade. The compressed air may be fed through both the wear tip and trailing portions at about room temperature of about 70° F. to 80° F. Alternatively, the compressed air may be fed at a temperature between about 5° C. and 40° C. The air can be treated by a dryer to remove excess moisture and control its relative humidity prior to being fed into the crimper.

The cooling effects of the invention allows use of more heat before the crimper for better crimp. The mechanical energy added to cause crimping and to force the tow through the stuffer box converts to heat energy causing an increase in tow temperatures of about 20° F. to 40° F. in the crimper. The cooling effects of the present invention offset this heat in the area immediately following the crimping action thereby allowing use of more heat before the crimper for better crimp formation. Temperatures of the tow entering the crimper have been successfully elevated by about 20 to 50° F. without significant levels of fusion between filaments of the tow. The air cools, softens, and tends to keep filaments from sticking together.

The invention is illustrated in the following nonlimiting examples. Each of the examples illustrated the crimping of polypropylene fiber. The fiber is treated with a finish in a manner known in the art to adjust the hydrophobic/hydrophilic properties of the fiber.

EXAMPLE 1

Hydrophilic polypropylene was produced using an apparatus and method according to the present invention. Specifically, the apparatus used in Tests 1–8 fed compressed air at room temperature through 147 holes in the wear tip section of the doctor blades. Each hole was 3/64 inch in diameter. Cooling water was circulated through two compartments in the trailing section. The water entered through one entrance passage and exited through two exit passages. The distance between the top and bottom doctor blade was 30 mm. The distance between the driven rolls was 0.001 inch and the distance between the doctor blades and driven rolls was 0.014 inch.

Comparative Example 1 also used steam before the crimper and compressed air in the crimper, but did not use cooling fluid in the trailing portion. The crimper used for the comparative example had 460 holes with a 3/64 inch diameter in each doctor blade including 3 rows of ten holes in the wear tip portion and 7 rows of ten holes in the trailing portion. The distance between the driven rolls was 0.001 inch and the distance between the doctor blades and driven rolls was 0.014 inch. The tow was fed into the driven rolls at 225 meters per minute. The processing variables and results of these tests are summarized in Table I.

The water temperature used for tests 1–8 was not measured. However, the inventor believes the temperature to be approximately 50° F. to 55° F. The flapper pressure for each of the comparative examples in tests 1–8 was not measured, however it was maintained constant and is believed to be approximately 6 psi for the comparative example and tests 1–8. The other processing variables listed in Table I are: temperature of the tow before the steam is applied, after the steam is applied and after the tow has been crimped, as well as the air pressure within the crimper and the steam pressure within the steam box before the crimper.

The following measurements of the fibers produced are also listed in Table I: two measurements of crimp, in crimps per inch, that were taken from different portions of the fiber; cohesion, which is a measure of the force in the linear direction needed to pull apart a bundle of fibers that have been carded to line them up linearly; openness, a standard test used in the fiber art, which is a measure of the volume of the fiber and the ability of the fiber to hold weight; leg which is a measurement of one of the sides of the crimp; the percent of the fiber that is not crimped; the open angle, which is a measure of the angle of the crimp; and the relaxed length versus stretched length, which is a measurement of the length of fiber without any-force being put on it divided by the length of fiber when it is stretched to remove crimp.

Fabric was made from each of the fibers in tests 1–8. The fabric was made on a small thermal bonding process line known to one of ordinary skill in the art, The line has prefeeders and openers to pull apart the large chunks of fiber from the compacted bale into small clumps to pass through feeds and stock transfer fans onto one or more roller-topped cards (up to four) where the fibers are spread, randomized and doffed onto a conveyor for transporting the layers of spread fibers to the calender. Calendering involved passing the spread layers of fiber between two heated rolls that are pressed together. One of the rolls is embossed with a diamond pattern having a land area of approximately 19%, and the other is smooth.

The fabric was measured using a fabric formation test wherein the fabric is viewed with a video camera. The image signal is digitized and analyzed for white reflectance and blackness distribution over the sample area as a measure of fabric uniformity. The results of the fabric measurement are listed in Table I as percent white; the standard deviation of the percent white; the percent thin, which is the amount of the black area measured in the fabric; the percent black in a 27 mm square portion of fabric; and the percent black in a 2.2 mm square portion of fabric. Further, the fabric was tested to determine its maximum cross-directional strength, which measures the amount of force required to pull apart a one-inch by five-inch portion of fabric. Finally, Table I includes the maximum temperature, which is the temperature of the thermal bonding of fabric that produced the maximum cross-directional strength.

The crimp, measured in crimps per inch (cpi), and cohesion of the fiber produced in Tests 1–8 was significantly improved over the fiber produced in the comparative example at the same flapper pressure. Additionally, the uniformity of fabric made with the fiber produced according to the present invention was improved. Specifically, fabric made from the fiber produced in Tests 1 and 2 showed improved white reflectance (percent white) and a reduction in the amount of black area (percent thin). These results indicate that the fibers produced using an apparatus and method according to the present invention produce improved fabric.

EXAMPLE 2

Hydrophobic polypropylene was produced using an apparatus and method according to the present invention. The apparatus used for the comparative example and the test examples were the same as the apparatus used in the comparative example and test examples of Example 1. Tests 9–19 were run with steam before the driven rolls, and cooling within the stuffer box. Comparative Example 2 was run with steam before the driven rolls and air in the crimper. The tow was fed into the driven rolls at 225 meters per minute. The processing variables and results of these tests are summarized in Table II, which includes all of the variables and results shown in Table I, as well as the standard deviation of the crimp and a second measurement for leg, open angle and relaxed length/stretched length.

The results indicate that the apparatus according to the present invention is capable of producing fiber with significantly higher crimp and cohesion at slightly lower flapper pressure (Test 9), as well as fiber with slightly higher crimp and cohesion at dramatically lower flapper pressure (Test 10). The measurement of cohesion for Tests 11–13 and 17–19 exceeded the range of the test equipment which reads a maximum cohesion of 8 grams/grain. The 20 psi steam pressure used for Tests 10, 11, 14 and 19 had previously been considered to be unusable because it would lead to fusion of the fibers. However, these tests produced satisfactory crimp.

EXAMPLE 3

Example 3 illustrates the effect of the temperature of the cooling water on the production of hydrophilic polypropylene fiber. The apparatus used was the same as the apparatus used in Example 1. The tow was fed into the driven rolls at 235 meters per minute. Tests 20–27 were run at the same flapper pressure. Tests 20–23 were run using water at 20° C. Tests 24–27 were run using water at 8° C. The test conditions and results are summarized in Table III. The results include two measurements of crimp that were taken from two portions of the fiber and the coefficient of variance of the crimp.

While the average for the crimp of Tests 20–23 (17.28 cpi) is not significantly different than the average for the crimp of Tests 24–27 (17.09 cpi), the cohesion average of Tests 24–27 (7.00 gm/grain) is significantly higher than Tests 20–21 (5.59 gm/grain). Accordingly, the apparatus and process is capable of producing fiber with variable levels of cohesion at approximately the same level of crimp.

Tests 28–38 were run at lower flapper pressure. The test results from Example 3 indicate better correlations at the higher flapper pressure. Specifically, higher flapper pressure produced improved results for crimp formation indicators such as crimp angle, percent noncrimp and relaxed length/stretched length. Further, as noted above, at higher flapper pressure, colder water produced improved cohesion without significant change in crimps per inch. While higher flapper pressure produced better correlations for crimp formation, both higher and lower flapper pressure produced fibers that yielded improved fabric uniformity.

Specifically, at the higher flapper pressure, higher air pressure improved fabric uniformity. At lower flapper pressure, lower air pressure improved fabric uniformity. Otherwise, changes in air pressure did not show any significant effects. The effect of precrimper steam was evident at both high and low flapper pressure. Application of steam raised cpi, cohesion, openness and improved fabric uniformity. Open angle, which was the best correlator with fabric uniformity, was lower and therefore produced a better crimp, at higher precrimp steam for both high and low flapper pressure. Precrimper steam also improved the quality and uniformity of crimp formation up to the point the filaments begin sticking together, crimping as clusters instead of individually.

The ranges of flapper pressure, 4.3 to 8.3 bars, and the range of crimper steam, 0–10 psi were wide enough to show that both improve crimp formation. Analysis of the data at constant water temperature and air pressure show that increased flapper pressure increased crimp by 2.7 cpi, cohesion by 1.5 gm/grain and fabric uniformity by 1.7%. Increased precrimp steam increased crimp by 3 cpi, cohesion by 1 gm/grain and uniformity by 2.7%. Since an inverse relationship exists between cohesion and fabric uniformity, this data shows that high flapper pressure and a proper level of precrimp steam improve crimp formation without sacrificing cohesion or fabric uniformity. Percent noncrimp may be more a measure of burnishing—which is a phenomena wherein the bend portions of the fiber nearest the doctor blades are rubbed under pressure by the heated surfaces thereby creating a polished portion—than the amount of crimp. The highest noncrimp levels occurred at highest flapper pressure and precrimp steam.

While the invention has been described with reference to several exemplary embodiments, it is understood that the words which have been used herein are words of description and illustration, rather that words of limitations. Changes may be made, without departing from the scope and spirit of the invention in its aspects. The invention extends to all functionally equivalent structures, methods and uses, such as are within the scope of the appended claims.

TABLE I

| | Comp. Ex. 1 | Test 1 | Test 2 | Test 3 | Test 4 | Test 5 | Test 6 | Test 7 | Test 8 |
|---|---|---|---|---|---|---|---|---|---|
| Flapper pressure (bars) | Approx. 6 | Approx. 6 | Approx. 6 | Approx. 6 | Approx. 6 | Approx. 6 | Approx. 6 | Approx. 6 | Approx. 6 |
| Temp Before Steam (°F.) | 133 | 130 | 138 | 137 | 131 | 132 | 131 | 132 | 131 |
| Temp After Steam (°F.) | 177 | 184 | 192 | 191 | 132 | 131 | 159 | 161 | 181 |
| Temp After Crimper (°F.) | 158 | 160 | 159 | 169 | 146 | 144 | 151 | 153 | 160 |
| Air Pressure (psi) | 5.0 | 0.0 | 0.0 | 10.0 | 0.5 | 5.0 | 10.0 | 0.5 | 5.0 |
| Steam Pressure (psi) | 5 | 5 | 10 | 10 | 0 | 0 | 1 | 1 | 5 |
| Avg. Crimp (CPI) 1 — | 18.5 | 22.4 | 22.1 | 23.6 | 20.7 | 20.4 | 18.7 | 21.0 | 22.7 |
| Avg. Crimp (CPI) 2 | 23.82 | 24.43 | 22.52 | 22.60 | 24.45 | 24.05 | 23.30 | 24.70 | 22.02 |
| Avg. Cohesion (gm/grain) | 4.91 | 6.45 | 6.00 | 5.20 | 5.31 | 4.90 | 4.85 | 5.80 | 5.97 |
| Avg. Openness | 35.36 | 33.09 | 29.83 | 31.55 | 37.45 | 36.84 | 35.24 | 35.05 | 33.70 |
| Avg. Leg (inch) | 0.0223 | 0.0215 | 0.0231 | 0.0233 | 0.0213 | 0.0220 | 0.0226 | 0.0216 | 0.0236 |
| Avg. Percent Non-crimp | 6.002 | 5.462 | 6.769 | 8.118 | 7.437 | 6.350 | 6.998 | 6.932 | 6.364 |
| Avg. Open Angle | 156.67 | 155.39 | 155.96 | 160.09 | 157.01 | 153.98 | 156.21 | 155.08 | 157.38 |
| Avg. Relaxed Length × Stretched Length | 0.957 | 0.959 | 0.960 | 0.956 | 0.956 | 0.948 | 0.960 | 0.953 | 0.960 |
| Percent White | 57 | 58 | 59 | 59 | 59 | 58 | 57 | 58 | 59 |
| Percent White SD | 9.7 | 9.7 | 9.7 | 9.9 | 9.7 | 9.6 | 10.1 | 9.8 | 10.1 |
| Percent Thin | 5.39 | 4.98 | 4.80 | 7.78 | 6.82 | 7.78 | 7.90 | 8.08 | 5.65 |
| Percent Black-27 | 0.04 | 0.04 | 0.08 | 0.68 | 0.42 | 0.65 | 1.06 | 0.91 | 0.61 |
| Percent Black-2.2 | 0.68 | 0.56 | 0.45 | 2.05 | 1.24 | 2.55 | 3.08 | 3.46 | 1.37 |
| Max. Cross Dir. Str'ngth (gms/inch) | 649 | 541 | 612 | 677 | 637 | 579 | 573 | 609 | 568 |
| Maximum Temp (°F.) | 161 | 161 | 161 | 164 | 164 | 164 | 158 | 164 | 161 |

TABLE II

| | Comp. Example 2 | Test 9 | Test 10 | Test 11 | Test 12 | Test 13 | Test 14 | Test 15 | Test 16 | Test 17 | Test 18 | Test 19 |
|---|---|---|---|---|---|---|---|---|---|---|---|---|
| Flapper Pressure (bars) | 9.3 | 5.5 | 2.5 | 8.5 | 8.5 | 5.5 | 2.5 | 2.5 | 2.5 | 8.5 | 8.5 | 5.5 |
| Temp Before Steam (°F.) | | 148 | 155 | 153 | 14 | 140 | 150 | 141 | 138 | 141 | 141 | 144 |
| Temp After Steam (°F.) | | 193 | 192 | 194 | 138 | 191 | 192 | 138 | 138 | 181 | 138 | 192 |
| Temp After Crimper (°F.) | | 154 | 152 | 155 | 142 | 153 | 148 | 131 | 131 | 152 | 155 | 153 |
| Air Pressure (psi) | 5.0 | 0.5 | 0 | 2 | 0 | 0.5 | 2 | 0 | 2 | 0 | 2 | 0.5 |
| Steam Pressure (psi) | | 10 | 20 | 20 | 0 | 10 | 20 | 0 | 0 | 20 | 0 | 20 |
| Avg. Crimp 1 | 19.3 | 24.444 | 20.102 | 27.871 | 28.209 | 25.940 | 22.714 | 22.697 | 19.896 | 27.554 | 26.406 | 24.018 |
| (psi) 2 | | 19.588 | 17.417 | 23.965 | 23.412 | 22.839 | 19.850 | 18.645 | 16.492 | 22.854 | 22.872 | 21.345 |
| Crimp SD | | 5.99 | 5.95 | 6.52 | 5.50 | 5.93 | 5.66 | 6.12 | 4.27 | 6.40 | 5.51 | 6.26 |
| Avg. Leg 1 | | 0.02228 | 0.02748 | 0.01911 | 0.01892 | 0.02129 | 0.02401 | 0.02408 | 0.02674 | 0.01931 | 0.01812 | 0.02295 |
| (inch) 2 | | 0.028 | 0.032 | 0.023 | 0.023 | 0.024 | 0.028 | 0.030 | 0.033 | 0.023 | 0.024 | 0.026 |
| Avg. Open 1 | | 140.210 | 140.750 | 145.840 | 141.920 | 140.950 | 142.010 | 142.920 | 138.840 | 143.890 | 141.340 | 138.130 |
| Angle 2 | | 153.271 | 154.597 | 155.863 | 155.536 | 152.333 | 149.743 | 163.689 | 158.957 | 157.273 | 165.324 | 162.010 |
| Avg. Relaxed Length 1 × | | 0.911 | 0.814 | 0.930 | 0.920 | 0.914 | 0.912 | 0.905 | 0.911 | 0.927 | 0.920 | 0.908 |
| Stretched Length 2 | | 0.970 | 0.972 | 0.975 | 0.975 | 0.968 | 0.962 | 0.988 | 0.981 | 0.978 | 0.990 | 0.985 |
| Avg. Percent Non-crimp | | 4.336 | 6.223 | 5.115 | 4.535 | 4.337 | 5.184 | 7.181 | 5.456 | 4.933 | 4.740 | 5.337 |
| Avg. Cohesion | 4.46 | 5.54 | 3.86 | 8.00 | 8.00 | 8.00 | 4.76 | 3.64 | 2.38 | 8.0 | 8.0 | 8.0 |
| Avg. Openness | | 44.05 | 43.54 | 43.42 | 45.45 | 43.67 | 42.80 | 46.31 | 44.46 | 43.97 | 46.20 | 44.10 |
| Percent White | | 48 | 49 | | | 50 | 43 | 53 | 49 | | | |
| Percent White SD | | 13.2 | 12.3 | | | 12.8 | 14.0 | 11.2 | 11.7 | | | |
| Percent Thin | | 17.21 | 12.46 | | | 12.26 | 19.29 | 11.68 | 42.1 | | | |
| Percent Black - 27 | | 25.76 | 5.65 | | | 5.12 | 28.41 | 7.27 | 9.89 | | | |
| Percent Black - 2.2 | | 24.37 | 9.99 | | | 8.76 | 30.06 | 10.89 | 14.31 | | | |
| Max. Cross Dir. Str'th (gm/in) | | 355 | 395 | | | 358 | 334 | 474 | 427 | | | |
| Maximum Temp. | | 169 | 166 | | | 166 | flat* | 166 | 166 | | | |

*Test did not yield a maximum temperature at which the maximum cross direction strength was achieved. The blank spaces in the comparative example indicated that the data was not recorded. The other blanks spaces indicate that fabric was not made from the fiber produced in these tests.

TABLE III

| | Test 20 | Test 21 | Test 22 | Test 23 | Test 24 | Test 25 | Test 26 | Test 27 | Test 28 | Test 29 |
|---|---|---|---|---|---|---|---|---|---|---|
| Flapper Pressure (bars) | 8.3 | 8.3 | 8.3 | 8.3 | 8.3 | 8.3 | 8.3 | 8.3 | 4.3 | 4.3 |
| Water Temp (°C.) | 20 | 20 | 20 | 20 | 8 | 8 | 8 | 8 | 20 | 20 |
| Temp Before Steam (°F.) | 134 | 132 | 130 | 134 | 134 | 132 | 133 | 135 | 134 | 132 |
| Temp After Steam (°F.) | 184 | 131 | 131 | 181 | 187 | 131 | 132 | 187 | 184 | 130 |
| Temp After Crimper (°F.) | 154 | 148 | 145 | 163 | 167 | 144 | 143 | 164 | 164 | 144 |
| Air Pressure (psi) | 5.0 | 1.0 | 5.0 | 1.0 | 5.0 | 1.0 | 5.0 | 1.0 | 5.0 | 1.0 |
| Steam Pressure (psi) | 10 | 0 | 0 | 10 | 10 | 0 | 0 | 10 | 10 | 0 |
| Crimp Avg. (cpi) | 23.6 | 23.4 | 23.2 | 26.2 | 25.9 | 22.7 | 23.5 | 25.8 | 24.6 | 20.4 |
| Crimp (CV) | 0.323 | 0.257 | 0.239 | 0.335 | 0.404 | 0.310 | 0.220 | 0.395 | 0.284 | 0.271 |
| Avg. Leg | 0.02326 | 0.01952 | 0.01599 | 0.01622 | 0.01631 | 0.01692 | 0.01888 | 0.01685 | 0.02281 | 0.01939 |

TABLE III-continued

| | | | | | | | | | | |
|---|---|---|---|---|---|---|---|---|---|---|
| (inch) | | | | | | | | | | |
| Crimp Avg. (inch) | 14.676 | 17.271 | 20.089 | 17.084 | 15.390 | 17.037 | 19.514 | 16.407 | 14.101 | 15.500 |
| Avg. Open Angle | 114.19 | 135.67 | 156.61 | 114.01 | 107.72 | 142.46 | 132.35 | 122.62 | 119.71 | 151.43 |
| Avg. Relaxed Length × Stret'd Length | 0.956 | 0.933 | 0.977 | 0.973 | 0.982 | 0.981 | 0.934 | 0.963 | 0.945 | 0.974 |
| Avg. Percent Non-crimp | 31.666 | 24.401 | 22.583 | 37.211 | 43.703 | 31.835 | 20.827 | 43.457 | 28.990 | 28.570 |
| Avg. Cohesion | 5.87 | 6.35 | 5.21 | 6.38 | 7.88 | 6.01 | 6.36 | 7.73 | 5.41 | 4.47 |
| Avg. Openness | 35.98 | 36.16 | 34.50 | 38.50 | 33.46 | 33.33 | 31.00 | 32.47 | 33.52 | 29.21 |
| % White | 56 | 50 | 51 | 57 | 52 | 52 | 54 | 52 | 53 | 53 |
| Percent White SD | 10.8 | 11.3 | 11.9 | 10.3 | 11.9 | 12.3 | 10.6 | 13.0 | 11.4 | 11.0 |
| % Thin | 6.55 | 10.35 | 12.67 | 5.95 | 9.35 | 15.99 | 7.66 | 16.41 | 11.21 | 12.75 |
| Percent Black-27 | 0.76 | 4.17 | 8.30 | 0.15 | 1.29 | 12.88 | 0.83 | 12.31 | 6.25 | 8.07 |
| Percent Black-2.2 | 1.86 | 7.06 | 11.07 | 0.85 | 4.22 | 15.97 | 2.62 | 16.47 | 8.22 | 11.76 |

| | Test 30 | Test 31 | Test 32 | Test 33 | Test 34 | Test 35 | Test 36 | Test 37 | Test 38 |
|---|---|---|---|---|---|---|---|---|---|
| Flapper Pressure (bars) | 4.3 | 4.3 | 4.3 | 4.3 | 4.3 | 4.3 | 6.3 | 6.3 | 6.3 |
| Water Temp (°C.) | 20 | 20 | 8 | 8 | 8 | 8 | 20 | 15 | 20 |
| Temp Before Steam (°F.) | 131 | 132 | 134 | 131 | 134 | 134 | 132 | 133 | 131 |
| Temp After Steam (°F.) | 130 | 182 | 184 | 129 | 132 | 185 | 175 | 177 | 180 |
| Temp After Crimper (°F.) | 140 | 162 | 160 | 140 | 144 | 159 | 157 | 159 | 157 |
| Air Pressure (psi) | 5.0 | 1.0 | 5.0 | 1.0 | 5.0 | 1.0 | 1.0 | 1.0 | 1.0 |
| Steam Pressure (psi) | 0 | 10 | 10 | 0 | 0 | 10 | 3 | 3 | 3 |
| Crimp Avg. (cpi) | 22.4 | 22.7 | 22.0 | 20.7 | 18.5 | 22.7 | 22.6 | 25.6 | 24 |
| Crimp (CV) | 0.275 | 0.280 | 0.273 | 0.315 | 0.257 | 0.336 | 0.263 | 0.288 | 0.272 |
| Avg. Leg (inch) | 0.02104 | 0.01601 | 0.01971 | 0.02341 | 0.01910 | 0.01695 | 0.01725 | 0.01811 | 0.01678 |
| Crimp Avg. (inch) | 16.435 | 17.360 | 17.067 | 14.727 | 15.995 | 14.635 | 18.027 | 16.393 | 17.66 |
| Avg. Open Angle | 142.12 | 126.18 | 141.07 | 135.26 | 152.6731 | 138.31 | 134.55 | 129.43 | 131.87 |
| Avg. Relaxed Length × Stret'd Length | 0.977 | 0.982 | 0.950 | 0.931 | 0.978 | 0.969 | 0.957 | 0.956 | 0.978 |
| Avg. Percent Non-crimp | 23.258 | 33.295 | 23.800 | 24.421 | 29.722 | 38.320 | 28.903 | 29.078 | 31.389 |
| Avg. Cohesion | 4.55 | 5.78 | 5.65 | 4.76 | 4.52 | 5.36 | 6.91 | 7.49 | 7.00 |
| Avg. Openness | 31.43 | 36.84 | 34.56 | 30.01 | 31.00 | 35.67 | 33.02 | 33.70 | 35.67 |
| % White | 52 | 57 | 53 | 52 | 56 | 57 | 53 | 54 | 51 |
| Percent White SD | 11.6 | 10.1 | 11.3 | 11.2 | 10.2 | 10.2 | 12 | 11.4 | 12.7 |
| % Thin | 16.58 | 7.47 | 10.34 | 11.05 | 9.92 | 8.32 | 10.03 | 8.79 | 10.62 |
| Percent Black-27 | 12.08 | 1.40 | 2.95 | 5.80 | 2.77 | 1.82 | 3.75 | 1.17 | 3.18 |
| Percent Black-2.2 | 12.5 | 2.29 | 6.62 | 9.96 | 6.03 | 3.50 | 5.41 | 3.73 | 5.04 |

What is claimed:

1. A crimper for crimping fiber, comprising:

a stuffer box comprising:

a first doctor blade;

a second doctor blade opposing said first doctor blade; and forming a crimping zone with said first doctor blade means for feeding fiber into said stuffer box; positioned upstream of said crimping space and means for directly cooling the stuffer box so as to indirectly cool fiber passing through said stuffer box.

2. A crimper according to claim 1, wherein said means for directly cooling the stuffer box so as to indirectly cool fiber is associated with at least one of said first doctor blade and said second doctor blade.

3. The crimper according to claim 2, wherein each of said first doctor blade and said second doctor blade comprises a wear tip portion and a trailing portion, and said means for directly cooling the stuffer box so as to indirectly cool fiber is positioned at said trailing portion of at least one of said first doctor blade and said second doctor blade.

4. The crimper according to claim 3, wherein said means for directly cooling the stuffer box so as to indirectly cool fiber is positioned at said trailing portion of each of said first doctor blade and said second doctor blade.

5. The crimper according to claim 3, wherein said means for directly cooling the stuffer box so as to indirectly cool fiber comprises at least one internal compartment for flow of cooling fluid in at least one of said first doctor blade and said second doctor blade.

6. The crimper according to claim 5, wherein said means for directly cooling the stuffer box so as to indirectly cool fiber comprises at least one internal compartment for flow of cooling fluid in each of said first doctor blade and said second doctor blade.

7. The crimper according to claim 6, wherein said at least one internal compartment comprises a plurality of compartments.

8. The crimper according to claim 7, wherein said plurality of compartments are interconnected.

9. The crimper according to claim 5, wherein at least one said wear tip portion of said first doctor blade and said second doctor blade comprises means for cooling.

10. The crimper according to claim 9, wherein said means for cooling said at least one wear tip portion comprise at least one internal passage including a plurality of exit apertures to inject a fluid into the stuffer box.

11. The crimper according to claim 10, wherein each said wear tip portions comprises a plurality of exit apertures to inject a fluid into the stuffer box.

12. The crimper according to claim 10, wherein said wear tip portion and said trailing portion of each of said first doctor blade and said second doctor blade comprise separate portions.

13. The crimper according to claim 12, wherein each of said first doctor blade and said second doctor blade further comprises a main body including:

at least one internal passage connected with said at least one internal passage in said at least one wear tip portion;

at least one internal passage for supplying cooling fluid to said at least one internal compartment; and at least one internal passage for removing cooling fluid from said at least one internal compartment.

14. The crimper according to claim 13, wherein said stuffer box comprises two opposing side plates.

15. The crimper according to claim 3, wherein said trailing portion of at least one of said first doctor blade and said second doctor blade further comprises at least one internal passage including a plurality of exit apertures to direct a fluid into the stuffer box.

16. The crimper according to claim 3, further comprising means for connecting one of said first doctor blade and said second doctor blade to said two opposing side plates.

17. The crimper according to claim 16, wherein said means for connecting comprise adjustable connecting means for adjusting one of said first doctor blade and said second doctor blade.

18. The crimper according to claim 17, wherein said first doctor blade and said second doctor blade are adjustably positioned opposing each other at a distance between about 15 mm and 60 mm.

19. The crimper according to claim 3, further comprising means for applying pressure within said stuffer box.

20. The crimper according to claim 3, wherein said means for feeding fiber comprise driven rolls.

21. The crimper according to claim 20, wherein said first doctor blade and said second doctor blade are positioned from said driven rolls at a distance between about 0.001 inch and 0.020 inch.

22. The crimper according to claim 21, wherein said driven rolls are spaced apart a distance of about 0.001 inch to 0,006 inch.

23. A crimper for crimping fiber, comprising:

a stuffer box comprising:

a first doctor blade;

a second doctor blade opposing said first doctor blade; and forming a crimping zone with said first doctor blade means for feeding fiber into said stuffer box; positioned upstream of said crimping space and means for cooling the stuffer box with a chilled cooling medium so as to indirectly cool fiber passing through said stuffer box.

24. The crimper according to claim 23, wherein said means for cooling the stuffer box with a chilled cooling medium indirectly cools said stuffer box.

25. The crimper according to claim 23, wherein said means for cooling the stuffer box is associated with at least one of said first doctor blade and said second doctor blade.

26. A crimper for crimping fiber, comprising:

a stuffer box comprising:

a first doctor blade comprising a wear tip portion and a trailing portion;

a second doctor blade opposing said first doctor blade comprising a wear tip portion and a trailing portion; said second doctor blade forming a crimping zone with said first doctor blade means for feeding fiber into said stuffer box; positioned upstream of said crimping space each said trailing portion of said first doctor blade and said second doctor blade comprising at least one internal compartment for flow of cooling liquid within each respective trailing portion; and each said wear tip portion of said first doctor blade and said second doctor blade comprising at least one internal passage including a plurality of exit apertures to inject a fluid into the stuffer box.

27. A crimper for crimping fiber, comprising:

a stuffer box comprising:

a first doctor blade;

a second doctor blade opposing said first doctor blade; and forming a crimping zone with said first doctor blade means for feeding fiber into said stuffer box; positioned upstream of said crimping space and means for cooling the stuffer box with a liquid cooling medium.

28. The crimper according to claim 27 wherein said means for cooling the stuffer box is associated with at least one of said first doctor blade and said second doctor blade.

29. A process for crimping fiber comprising:

heating the fiber;

feeding the heated fiber, at a rate capable of crimping the fiber, into a stuffer box having a first doctor blade, and a second doctor blade opposing said first doctor blade; and cooling the fiber as the fiber passes through the stuffer box with a cooling fluid which directly cools the stuffer box and indirectly cools the fiber.

30. The process according to claim 29, wherein each of the first doctor blade and the second doctor blade comprises a wear tip portion and a trailing portion, and the cooling fluid directly cools the trailing portion of at least one of the first doctor blade and the second doctor blade.

31. The process according to claim 30, wherein the heating comprises applying steam.

32. The process according to claims 31, wherein the liquid has a temperature between about 5° C. and 40° C.

33. The process according to claim 30, wherein the cooling fluid directly cools the trailing portion of each of the first doctor blade and the second doctor blade.

34. The process according to claim 29, wherein the cooling fluid which directly cools the stuffer box and indirectly cools the fiber comprises a liquid.

35. The process according to claim 34, wherein the cooling fluid which directly cools the stuffer box and indirectly cools the fiber comprises a chilled liquid.

36. The process according to claim 29, wherein the trailing portion of at least one of the first doctor blade and the second doctor blade comprises at least one internal compartment, and the cooling fluid which directly cools the stuffer box and indirectly cools the fiber is circulated through the at least one internal compartment.

37. The process according to claim 36, wherein the trailing portion in each of the first doctor blade and the second doctor blade comprises at least one internal compartment, and the cooling fluid which directly cools the stuffer box and indirectly cools the fiber is circulated through the at least one internal compartment.

38. The process according to claim 37, wherein the at least one compartment comprises a plurality of internal compartments.

39. The process according to claim 36, wherein the wear tip portion of at least one wear tip portion of the first doctor blade and the second doctor blade comprises at least one internal passage including a plurality of exit apertures, and an additional cooling fluid is injected through the plurality of exit apertures into the stuffer box.

40. The process according to claims 39, wherein the trailing portion and wear tip portion comprise separate portions of each of the first doctor blade and the second doctor blade.

41. The process according to claim 40, wherein each of the first doctor blade and the second doctor blade further comprises a main body including:

at least one internal passage connected with the at least one internal passage in said wear tip portion;

at least one internal passage for supplying cooling fluid to said at least one internal compartment; and at least one internal passage for removing cooling fluid from said at least one internal compartment.

42. The process according to claim 39, wherein said cooling fluid injected through the plurality of exit apertures comprises air.

43. The process according to claim 39 wherein the wear tip portion of each of the first doctor blade and the second doctor blade comprises at least one internal passage including a plurality of exit apertures, and an additional cooling fluid is injected through each plurality of exit apertures into the stuffer box.

44. The process according to claim 43, wherein the additional cooling fluid comprises compressed air at a temperature between about 5° C. and 40° C.

45. The process according to claim 43, wherein said cooling fluid injected through the plurality of exit apertures comprises, air.

46. The process according to claim 45, wherein the air is applied at a pressure between about 0.5 and 15 psi.

47. The process according to claim 36, wherein the trailing portion of at least one of the first doctor blade and the second doctor blade comprises at least one internal passage including a plurality of exit apertures, and a cooling fluid is injected through the plurality of exit apertures into the stuffer box to directly contact the fiber.

48. The process according to claim 29, further comprising applying pressure within the stuffer box.

49. The process according to claim 29, wherein the temperature of the fiber entering the stuffer box is between about 90° F. and 200° F., and the temperature of the fiber leaving the stuffer box is between about 130° F. and 180° F.

50. The process according to claim 29, wherein the fiber is a polyolefin.

51. The process according to claim 50, wherein said polyolefin is selected from the group consisting of polypropylene, polyethylene, and mixtures thereof.

52. The process according to claim 51, wherein the polyolefin is polypropylene.

53. A process for crimping fiber, which process enables control of crimping by adjusting temperature conditions, comprising:

heating the fiber;

feeding the heated fiber, at a rate capable of crimping the fiber, into a stuffer box comprising:

a first doctor blade comprising a wear tip portion and a trailing portion;

a second doctor blade opposing the first doctor blade comprising a wear tip portion and a trailing portion;

each said trailing portion of the first doctor blade and the second doctor blade comprising at least one internal compartment for flow of liquid within each respective trailing portion; and each said wear tip portion of the first doctor blade and the second doctor blade comprising at least one internal passage including a plurality of exit apertures to inject a fluid into the stuffer box;

controlling at least one of temperature and flow rate of liquid flowing through the internal compartment in each of the first doctor blade and the second doctor blade; and controlling at least one of flow rate and temperature of the fluid being injected into the stuffer box.

54. A doctor blade comprising:

a wear tip portion; and a trailing portion including means for cooling with a liquid and wherein said means for cooling comprises at least one internal compact for flow of cooling liquid.

55. The doctor blade according to claim 54, wherein said wear tip portion comprises at least one internal passage including a plurality of exit apertures.

56. The doctor blade according to claim 55, further comprising a main body including:

at least one internal passage connected with said at least one internal passage in said wear tip portion;

at least one internal passage for supplying cooling liquid to said at least one internal compartment; and at least one internal passage for removing cooling liquid from said at least one internal compartment.

57. The doctor blade according to claim 56, wherein said at least one internal compartment for flow of cooling liquid comprises a plurality of internal compartments.

58. The doctor blade according to claim 57, wherein said plurality of internal compartments are connected through at least one flow passage.

59. The doctor blade according to claim 55, wherein said trailing portion further comprises at least one internal passage including a plurality of exit apertures.

60. A process for Crimping fiber, comprising:

heating the fiber;

feeding the heated fiber, at a rate capable of crimping the fiber, into a stuffer box comprising:

a first doctor blade comprising a wear tip portion and a trailing portion;

a second doctor blade opposing the first doctor blade comprising a wear tip portion and a trailing portion;

each said trailing portion of the first doctor blade and the second doctor blade comprising at least one internal compartment for flow of liquid within each respective trailing portion; and each said wear tip portion of the first doctor blade and the second doctor blade comprising at least one internal passage including a plurality of exit apertures to inject a fluid into the stuffer box;

circulating a liquid through the internal compartment in each of the first doctor blade and the second doctor blade; and injecting a fluid into the stuffer box through the plurality of exit apertures in each of the first doctor blade and the second doctor blade.

61. The process according to claim 60, wherein at least one of liquid and fluid are cooled.

62. The process according to claim 60, wherein the liquid comprises water and the fluid comprises air.

* * * * *

UNITED STATES PATENT AND TRADEMARK OFFICE

CERTIFICATE OF CORRECTION

PATENT NO. : 5,485,662

DATED : January 23, 1996

INVENTOR(S) : Ray W. Hodges, Jr. and Shiv Sibal

It is certified that error appears in the above-indentified patent and that said Letters Patent is hereby corrected as shown below:

Claim 54, column 20, line 64 "compact" should read --compartment--.

Claim 60, column 21, line 18 "Crimping" should read --crimping--.

Signed and Sealed this

Fourth Day of June, 1996

*Attest:*

*Attesting Officer*

BRUCE LEHMAN

*Commissioner of Patents and Trademarks*